United States Patent [19]

Lee

[11] Patent Number: 4,821,419

[45] Date of Patent: Apr. 18, 1989

[54] BLIND NAILER

[75] Inventor: Leonard G. Lee, Ottawa, Canada

[73] Assignee: Lee Valley Tools Ltd., Ottawa, Canada

[21] Appl. No.: 90,946

[22] Filed: Aug. 28, 1987

[51] Int. Cl.[4] ..... B27G 17/02

[52] U.S. Cl. ..... 30/493; 30/167

[58] Field of Search ..... 30/493, 167, 167.1, 30/480, 484, 486, 346.55, 164.8, 351, 48, 49; 409/113, 118

[56] References Cited

U.S. PATENT DOCUMENTS

| | | | |
|---|---|---|---|
| 369,908 | 9/1887 | Blair | 30/480 |
| 902,977 | 11/1908 | Link | 30/486 |
| 3,026,920 | 3/1962 | York | 81/436 |

OTHER PUBLICATIONS

Patented Transitional and Metallic Planes in America, 1827–1927, p. 101, The North Village Publishing Co., 1981.

Stanley No. 96 "Chisel Gauge".

Conover blind nailer.

AMT blind nailer.

*Primary Examiner*—Frederick R. Schmidt

*Assistant Examiner*—Maurina Rachuba

*Attorney, Agent, or Firm*—Kilpatrick & Cody

[57] ABSTRACT

A blind nailer plane having an improved iron or chisel with a cutting edge which is straight through its central portion and curves upward on either end in order to produce a shaving which is cleanly cut from a workpiece and may therefore be glued in place leaving few surface imperfections.

3 Claims, 1 Drawing Sheet

BLIND NAILER

BACKGROUND OF THE INVENTION

The present invention relates to woodworking planes and plane "irons" or blades and to methods for hiding metal fasteners used to fix wood members.

It is frequently desirable to fasten wood members, such as picture frame or furniture members and millwork or trim around windows and doors, utilizing metal fasteners such as nails or screws. It is also desirable to hide such metal fasteners. For instance, screws are often driven in countersunk holes and then covered with a wood plug fixed in the hole. However, even if the plug is machined flush with the surface of the workpiece, it will be readily visible unless its grain is very carefully matched and aligned with the surrounding wood grain. Doing so is extremely difficult and time consuming, if possible at all.

Both nails and screws have long been hidden by the alternative procedure of raising a small shaving of wood in the spot where the fastener is to be placed, locating the nail or screw in the depression left by the wood shaving, and gluing the shaving back in place. The shaving may be raised with a variety of tools, but a chisel is most frequently used. A chisel can be utilized freehand, but the desired control of shaving thickness and length is difficult to achieve. As a result a small "blind nailer" plane body has long been used to hold a conventional chisel at a fixed angle with respect to the wood surface and with a fixed portion of the chisel cutting edge protruding beyond the sole of the plane in order to facilitate raising shavings of uniform thickness and of desired length.

Conventional chisels utilized with such chisel holding planes typically raise a shaving which has a substantially rectangular cross-section and edges which are not cut but are broken or torn free of surrounding wood tissue. Consequently, such edges are ragged, and it is therefore often difficult to glue the shaving back in place in such a way that the wood surface is smooth and the shaving edges are not easily detected visually.

Additionally, conventional chisels are longer than is desirable for use in a blind nailer plane body in view of the typical blind nailer and human hand geometry and dimensions.

SUMMARY OF THE INVENTION

The blind nailer plane of the present invention utilizes a plane "iron" or cutting blade, here referred to as a chisel, having a shaft with a substantially rectangular cross-section at the cutting end. The cutting end or tip is ground and honed to have a flat or planar bevel on one side of the chisel and, on the other side, both a surface which is rounded or curved transverse to the longitudinal chisel shaft axis and substantially symmetrical about that axis and a centered, small flat or planar bevel. The two planar bevels form an acute angle of approximately thirty degrees (30°). This results in a cutting edge at the chisel tip which has a substantially straight central portion and ends which curve upward when the chisel is fixed in the blind nailer plane body. As a result, in use a chip or shaving is raised which has a flat bottom and curved edges which are cut rather than torn as the shaving is raised and which curve upward to intersect the shaving top surface at a steep angle. Consequently, those edges are not ragged, and they reseat cleanly when the shaving is glued back down, thereby making it less possible visually to detect the fact that a chip or shaving was raised or to deduce that a fastener has been installed under the chip. Such a shaving also has sufficient thickness across a substantial portion of its width to successfully hide metal fasteners in somewhat translucent woods like white pine or sugar pine. In such woods, portions of a screw or nail head under thin portions of a shaving near the shaving edge may show through the shaving. Because the shaving has a flat bottom, the central portion of the shaving is not so thick, however, that the shaving fractures as it is raised and curls upward. Such control of shaving thickness to avoid fracturing is particularly important in brittle woods such as cherry.

It is thus possible utilizing the present invention to raise wood shavings for the purpose of hiding metal fasteners which shavings may be glued back in place more easily and with less possibility of visual detection.

The present invention thereby enhances the ability of a woodworker who has mastered its simple operation to achieve the dual objectives of utility and aesthetic delight which are central aspirations of working wood.

DETAILED DESCRIPTION OF THE DRAWINGS

Figure 1:
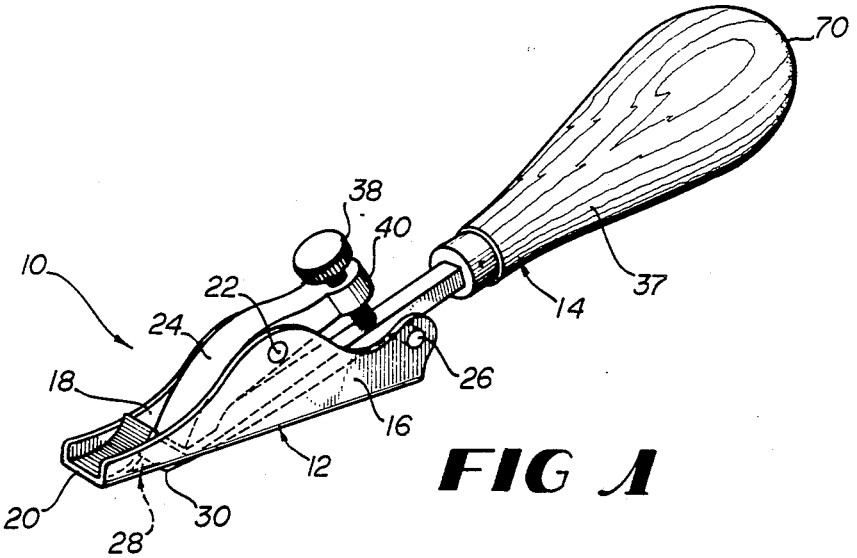
FIG. 1 is a perspective view of the blind nailer chisel of the present invention mounted in a blind nailer plane body with the portions of the chisel and plane lever cap obscured by the plane body side shown in broken lines.

FIG. 1 is a perspective view of the "blind nailer" wood shaving-raising plane 10 of the present invention, which comprises generally a plane body 12 and a plane "iron" or chisel 14. Plane body 12, also illustrated in FIG. 2, may be fabricated in numerous configurations. In the embodiment illustrated in FIGS. 1 and 2, plane body 12 is formed of sheet metal to have parallel sides 16 and 18 which each form a right angle with sole 20. A lever cap pin 22 located near the longitudinal centers and near the upper edges of sides 16 and 18 passes through sides 16 and 18 and provides a pivot for lever cap 24 through which pin 22 passes. Lever cap 24 may be cast from brass or other suitable metal or fabricated according to other conventional techniques. A second pin, chisel pin 26, spans the space between sides 16 and 18 near the rear of plane body 12 and provides a rear bearing point for chisel 14. An opening or throat 28, through which the tip 30 of chisel 14 may protrude, is provided in the forward portion of sole 20.

In the illustrated embodiment of plane body 12, throat 28 is formed by punching a rectangular tongue 32 from sole 20 so that the tongue remains attached to sole 20 and curls upward between sides 16 and 18. Tongue 32 is formed by separating it from sole 20 along a throat edge 34 which is transverse to sole 20 and extends forward along the intersections of sides 16 and 18 with sole 20. Lever cap 24 holds chisel 14 shaft 36 within and in rigid contact with plane body 12 against the transverse portion of throat edge 34 and against chisel pin 26. This is accomplished in the illustrated embodiment of the present invention by rotating a thumb screw 38 mounted in the upper end 40 of lever cap 24 so that the end of thumb screw 38 presses against the shaft 36 of chisel 14 substantially opposite chisel pin 26. Rotation of thumb screw 38 to advance it thereby levers the opposite end of lever cap 42 against chisel shaft 36 substantially opposite throat edge 34 of throat 28 in sole 20, thereby rigidly but adjustably fixing chisel 14 within plane body 12 to permit the desired protrusion of chisel tip 30 below the sole 20 of plane body 12.

Figure 2:
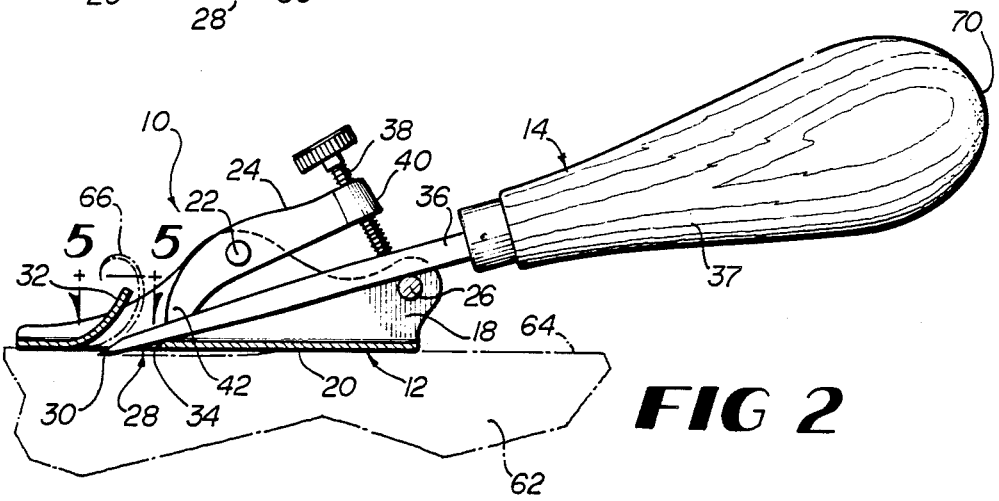
FIG. 2 is a side elevation of the invention illustrated in FIG. 1 shown with a workpiece and with one side of the plane body broken away.
Figure 3:
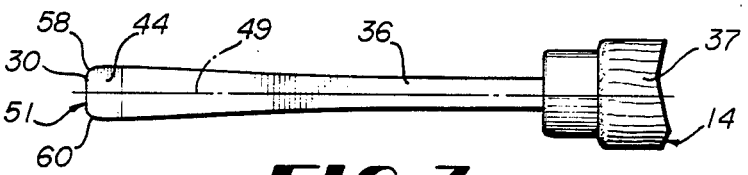
FIG. 3 is a top plan view of the chisel of the present invention shown with a portion of the handle broken away.
Figure 4:
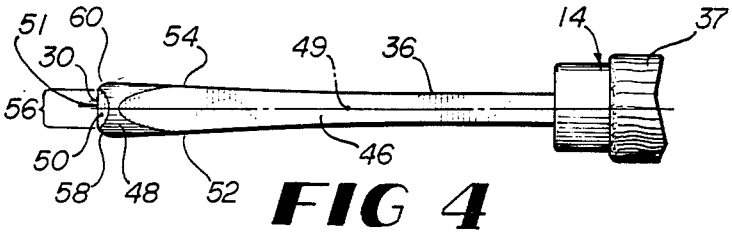
FIG. 4 is a bottom plan view of the chisel of the present invention shown with a portion of the handle broken away.

FIGS. 3 and 4 illustrate the top and bottom, respectively, of the shaft 36 of chisel 14 and a portion of chisel handle 37. The side of shaft 36 is, of course, illustrated in FIG. 2. Shaft 36 has a rectangular cross section which may, as in the illustrated embodiment, gently taper along its length so that the shaft is wider near its tip 30 than at the opposite (handle 37) end and not as thick at tip 30 as at the handle 37 end. Such shaft 36 taper and the cross-sectional shape of shaft 36 is largely a matter of design choice, provided that shaft 36 has a substantially rectangular cross section at tip 30 (prior to grinding and honing as described below) or that the below-described tip shape is otherwise achieved. The width of shaft 36 and tip 30 must be at least slightly less than the distance between plane body 12 sides 16 and 18 so that tip 30 can pass through throat 28 and shaft 36 will fit between plane body sides 16 and 18. If desired, the tip 30 and shaft 36 widths can, however, be substantially less than the distance between sides 16 and 18.

Chisel 14 tip 30 is ground and honed to have a flat or planar upper bevel 44 (shown in FIG. 3) at an angle to the longitudinal axis 49 of shaft 36 which roughly approximates fifteen degrees (15°). (In accordance with the convention typically employed in tool-sharpening terminology, reference to the "angle" a bevel or other surface forms to another surface or a designated line means the angle formed between (a) a first imaginary line on that bevel or other surface and normal to the surface edge and (b) the designated line or an imaginary line on the other surface also normal to the surface edge and intersecting the first imaginary line.)

Importantly, the lower side of shaft 36 (see FIG. 4) is ground and honed to produce a rounded or curved surface 48 which is symmetrical about the longitudinal axis 49 of shaft 36 and a flat or planar lower bevel 50 immediately adjacent to the tip 30. Bevel 50 forms an angle with the shaft 36 longitudinal axis 49 of roughly fifteen degrees (15°) and intersects upper bevel 44 so that the angle between upper bevel 44 and lower bevel 50 roughly approximates thirty degrees (30°).

If lower bevel 50 were not present, the intersection of curved surface 48 and upper bevel 44 at chisel tip 30 to form cutting edge 51 would be a curved line; however, the intersection of upper bevel 44 and lower bevel 50 modifies a portion of that curve to make it a straight line. Since, as may be seen by reference to FIG. 4, lower bevel 50 does not extend to the sides 52 and 54 of shaft 36, the resulting cutting edge 51 of chisel 14 is straight in a central portion 56 and curved at "corners" 58 and 60 adjacent to the sides 52 and 54.

As will be appreciated by the preceding description of cutting edge 51, curved surface 48 may be a semi-cylindrical surface, a frusto-conical surface section or any other suitable surface which is substantially symmetrical about the shaft 36 longitudinal axis 49 and curved, rounded or elliptical transverse to that axis 49.

As will be appreciated by reference to FIGS. 3 and 4 illustrating the above-described geometry of tip 30 and by reference to FIG. 2 showing orientation in use of chisel 12 to a workpiece 62, the central portion 56 of cutting edge 51 of chisel 14 lies parallel to and below the surface 64 of workpiece 62, and edge 51 curves up out of the workpiece surface 64 on each side of central portion 56.

Figure 5:
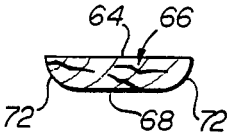
FIG. 5 is a cross-section of a typical wood shaving produced utilizing the present invention.

A resulting shaving 66 has a cross section similar to that shown in FIG. 5, with a substantially flat bottom 68 and sides 72 which curve up from that bottom to top surface 64. As will be readily appreciated by one skilled in the art, sides 72 are cut by the above described cutting edge 51 of chisel 14, and shaving 66 is therefore cleanly separated from workpiece 62, rather than torn away, as occurs if a conventional straight cutting edge chisel is used. Such a straight chisel would cut the bottom 68 but tear or break shaving 66 sides 72 away from the workpiece 62.

Blind nailer plane 10 of the present invention is, in general, used in the conventional manner well familiar to persons skilled in the art. The plane is located on a workpiece substantially parallel to its wood grain, with tip 30 slightly in front of the desired wood fastener location. Plane 10 is then moved forward to establish and maintain firm contact between sole 20 and surface 64 of workpiece 62 as chisel tip 30 cuts into workpiece 62, thereby raising a shaving 66 which is cut from workpiece 62 as described above and which protrudes up through sole opening 28, typically curling forward as is illustrated in FIG. 2. Because of the modest length of chisel 14, plane 10 may be held during use in one hand with the user's forefinger pressing down on plane body 12 just in front of tongue 32, with the thumb on one side and the middle finger on the opposite side of plane body 12 and with the butt 70 of chisel 14 pressed against the heel of the user's hand by the ring and little fingers. The ability to so grip blind nailer plane 10 advantageously permits controlled transmission of force from the user's arm and hand in the direction needed, along the longitudinal axis 49 of chisel 14 shaft 36.

After a shaving 66 of desired length has been raised, plane 10 is drawn backward to remove it from the workpiece while leaving shaving 66 attached. The desired fastener is then affixed in the depression left by shaving 66 in the surface 64 of workpiece 62. Shaving 66 may thereafter be glued back in the depression using fish glue or any other appropriate adhesive.

Persons skilled in the art will readily recognize that other embodiments of the above described invention may be easily constructed and utilized while continuing to realize the advantages of the described invention and without departing from the scope and spirit of the preceding description and the following claims.

I claim:

1. A woodworking chisel for use in a plane body, comprising a metal shaft fixed to a handle on one end and having at the other end a cutting edge having a substantially straight central portion and curved ends defined by:

a. a first bevel extending entirely across the shaft, and b. on the side of the shaft opposite the first bevel:

(i) a second, centered bevel which intersects the central portion of the first bevel at the cutting edge, and (ii) a contour symmetrical about the longitudinal axis of the shaft and curved transverse to that axis so that the contour intersects the first bevel on both sides of the second bevel.

2. A blind nailer plane, comprising:

a. a plane body, and, adjustably fixed in the plane body, b. a chisel comprising a metal shaft having at the cutting end a substantially rectangular cross section and a cutting edge having a substantially straight central portion and curved ends, which cutting edge is defined by a first bevel extending entirely across one side of the shaft, and on the other side of the shaft:

(i) a second, centered bevel which intersects the central portion of the first bevel at the cutting edge, and (ii) a contour symmetrical about the longitudinal axis of the shaft and curved transverse to that axis so that the contour intersects the first bevel on both sides of the second bevel.

3. A method for forming a cutting edge on the tip of a chisel, comprising the steps of:

a. forming a substantially planar first surface on the tip of the chisel at a shallow angle to the longitudinal axis of the shaft, b. forming on the side of the shaft opposite the first surface and adjacent to the tip, a contoured surface which is symmetrical about the longitudinal shaft axis, curved transverse to that axis and intersects the first surface; and c. modifying the contoured surface by forming a centered, substantially planar second surface on the shaft to intersect the first surface at an acute angle.

* * * * *